US008087448B2

(12) United States Patent
Nakayama et al.

(10) Patent No.: US 8,087,448 B2
(45) Date of Patent: Jan. 3, 2012

(54) ROLL POLISHING APPARATUS

(75) Inventors: Katsumi Nakayama, Tokyo (JP); Hiroyuki Otsuka, Tokyo (JP); Shiro Osada, Yokohama (JP); Hisahiko Fukase, Yokohama (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 12/867,848

(22) PCT Filed: Mar. 21, 2008

(86) PCT No.: PCT/JP2008/000664

§ 371 (c)(1),
(2), (4) Date: Aug. 16, 2010

(87) PCT Pub. No.: WO2009/116119

PCT Pub. Date: Sep. 24, 2009

(65) Prior Publication Data

US 2011/0119858 A1 May 26, 2011

(51) Int. Cl.
*B22D 11/06* (2006.01)

(52) U.S. Cl. ..... 164/428; 164/158; 164/429; 164/480

(58) Field of Classification Search ..... 164/158, 164/428, 429, 479, 480
See application file for complete search history.

(56) References Cited

U.S. PATENT DOCUMENTS

| | | | |
|---|---|---|---|
| 2002/0088602 | A1 | 7/2002 | Kato et al. |
| 2010/0205765 | A1 | 8/2010 | Otsuka et al. |

FOREIGN PATENT DOCUMENTS

| | | |
|---|---|---|
| JP | 58 163509 | 9/1983 |
| JP | 58 223556 | 12/1983 |
| JP | 60 14835 | 1/1985 |
| JP | 6-114507 | 4/1994 |
| JP | 6 114507 | 4/1994 |
| JP | 2000 644 | 1/2000 |

*Primary Examiner* — Kuang Lin

(74) *Attorney, Agent, or Firm* — Oblon, Spivak, McClelland, Maier & Neustadt, L.L.P.

(57) ABSTRACT

A roll polishing apparatus that can suppress cracks on a strip. The roll polishing apparatus includes brush rolls which face outer periphery of chilled rolls over an axial length of the chilled rolls, respectively, cylinders which urge the brush rolls wholly to the chilled rolls, respectively, and cylinders which deform the brush rolls in conformity to crowns of the chilled rolls, respectively. By these elements, wires of the brush rolls are uniformly contacted on outer peripheries of the chilled rolls to wipe off oxides adhering to the outer peripheries of the chilled rolls.

6 Claims, 5 Drawing Sheets

ROLL POLISHING APPARATUS

TECHNICAL FIELD

The present invention relates to a roll polishing apparatus used for a twin roll caster.

BACKGROUND ART

Known as one of techniques for production of a strip directly from molten metal is twin-roll continuous casting where the molten metal is supplied between a pair of chilled rolls arranged horizontally to deliver the solidified metal as a strip.

FIG. 5 shows an example of such twin roll caster comprising a pair of chilled rolls 1 arranged horizontally and a pair of side weirs 2 associated with the rolls 1.

The chilled rolls 1 with cooling water passing therethrough are constructed such that a nip G between the rolls may be adjusted to be increased/decreased depending on thickness of the strip 3 to be produced.

Rotational directions and velocities of the chilled rolls 1 are set such that outer peripheries of the rolls 1 are moved from above toward the nip G at constant velocity.

One and the other of the side weirs 2 surface-contact one and the other ends of the chilled rolls 1, respectively. In a space defined by the chilled rolls 1 and the side weirs 2, a molten metal supply nozzle 4 made of refractory material is arranged to be positioned just above the nip G between the rolls.

The molten metal supply nozzle 4 has an elongated top nozzle trough 6 for reception of molten metal 5 and has longitudinal side walls each formed with openings 7 adjacent to a lower end of the nozzle and extending from the trough 6 toward outer peripheries of the chilled rolls 1, the openings 7 being aligned along axes of the rolls 1. Thus, the molten metal 5 is poured into the nozzle trough 6 to form a molten metal pool 8 above the nip G between the chilled rolls 1 and in contact with the outer peripheries of the rolls 1.

Thus, with the molten metal pool 8 being formed, the chilled rolls 1 are rotated while being cooled by passing of the cooling water therethrough, so that the molten metal 5 is solidified on the outer peripheries of the rolls 1 into shells which are brought together at the nip G into the strip 3 which in turn is delivered downwardly from the rolls 1.

In this case, in order that the strip 3 produced may have a target thickness, horizontal pushing forces are applied to bearing chocks (not shown) for support of necks on the respective chilled rolls 1 in directions toward each other.

When oxides of, for example, the molten metal 5 adhere to the outer peripheries of the chilled rolls 1 in the molten metal pool 8, an effect of cooling the solidified shells at oxides-adhering regions becomes insufficient and cracks may develop on the surfaces of the strip 3.

In order to overcome this, there has been proposed a roll brushing device with brush rolls facing the outer peripheries of the chilled rolls 1 over axial lengths thereof, respectively. While being rotated by motors, the brush rolls are pushed against the chilled rolls 1 to wipe off the oxides adhering to the outer peripheries of the rolls 1 (see, for example, Patent Literature 1).

In Patent Literature 1, speaking exaggeratingly, in complementary with the chilled rolls 1 hourglass-shaped or having axially opposite ends greater in outer diameter than axially intermediate portions, the brush rolls are barrel-shaped or have axially opposite ends smaller in outer diameter than axially intermediate portions (difference in outer diameter between the axially opposite ends and the axially intermediate portions in the chilled rolls 1 or in the brush rolls is of the order of 0.4 mm).

[Patent Literature 1] JP 6-114507A

SUMMARY OF INVENTION

Technical Problems

However, thermal deformations of the chilled rolls 1 are so complex that, even if the barrel-shaped brush rolls are used, wires of the brush rolls do not always evenly contact the outer peripheries of the rolls 1.

Moreover, the brush rolls 9 with their necks being pushed toward the chilled rolls 1 by the cylinders 10 are rotated in such bent manner, so that the wires of the axially opposite ends of the brush rolls are heavily worn. As a result, at the axially opposite ends of the outer peripheries of the chilled rolls 1, the wires of the brush rolls do not always evenly contact the outer peripheries of the rolls 1.

Thus, oxides adhering to somewhere around widthwise ends and intermediate portions of the outer peripheries of the chilled rolls 1 cannot be completely wiped off by mere use of the brush rolls 9, and may increase in thickness. As a result, heat removal is lowered at the regions where the oxides are not completely wiped off, resulting in unevenness in heat removal over the width of the strip, so that cracks may develop somewhere around the widthwise ends or intermediate portions of the surfaces of the strip 3.

The invention has its object to provide a roll polishing apparatus capable of suppressing cracks on surfaces of a strip.

Solution to Problems

In order to attain the above object, the invention comprises rotatively driven brush rolls which face outer peripheries of chilled rolls of a twin roll caster over axial lengths thereof, respectively, pushing means for urging said brush rolls wholly to the chilled rolls, respectively, and bending means for deforming said brush rolls in conformity to crowns of the chilled rolls, respectively.

Specifically, during the production of a strip, the brush rolls are urged by the pushing means to the chilled rolls and are deformed by the bending means in conformity to the crowns of the chilled rolls, respectively, so as to keep the wires on the brush rolls evenly contacting the outer peripheries of the chilled rolls over axial lengths thereof, respectively.

In addition, each of the brush rolls has a periphery formed such that axially opposite ends of the brush roll are smaller in outer diameter than an axially intermediate portion. Thus, convex deformation of the brush rolls toward the chilled rolls causes tips of the wires on the axially opposite ends of the brush rolls to properly contact the outer peripheries of the chilled rolls.

Further, the apparatus comprises, independently of the brush rolls, rotatively driven auxiliary brush rolls which face the outer peripheries of the chilled rolls, respectively, and pushing means for urging said auxiliary brush rolls wholly to the chilled rolls, respectively, the outer peripheries of the chilled rolls being also polished by the auxiliary brush rolls, respectively.

The auxiliary brush rolls used are those which face the outer peripheries of the chilled roll over the lengths thereof, respectively, each of said auxiliary brush rolls having a periphery such that the axially opposite ends of the brush roll is greater in outer diameter than the axially intermediate portion.

Advantageous Effects of Invention

According to a roll polishing apparatus of the invention, the following effects and advantages can be obtained.

(1) When the brush rolls are deformed in their axes by the bending means in conformity to the crowns of the chilled rolls, the wires of the brush rolls evenly contact the outer peripheries of the chilled rolls over the axial lengths thereof, so that the oxides adhering to the outer peripheries of the chilled rolls can be effectively wiped off, and no cracks develop somewhere around the widthwise edges and intermediate portions of the surfaces of the strip.

(2) Since the axially opposite ends of each of the brush rolls are smaller in outer diameter than axially intermediate portion of the brush roll, convex deformation of the brush rolls to the chilled rolls causes tips of the wires of the axially opposite ends of the brush rolls to properly contact the outer peripheries of the chilled rolls, which ensures wipe-off of the oxides at the regions.

(3) When the auxiliary brush rolls are provided independently of the brush rolls, specific areas on the outer peripheries of the chilled rolls can be circumferentially polished intensively by the auxiliary brush rolls.

REFERENCE SIGNS LIST

1 chilled roll
9 brush roll
10 pushing cylinder (pushing means)
11 bending cylinder (bending means)
12 auxiliary brush roll
13 pushing cylinder (pushing means)
14 auxiliary brush roll

DESCRIPTION OF EMBODIMENTS

Next, embodiments of the invention will be described in conjunction with the drawings.

Figure 1:
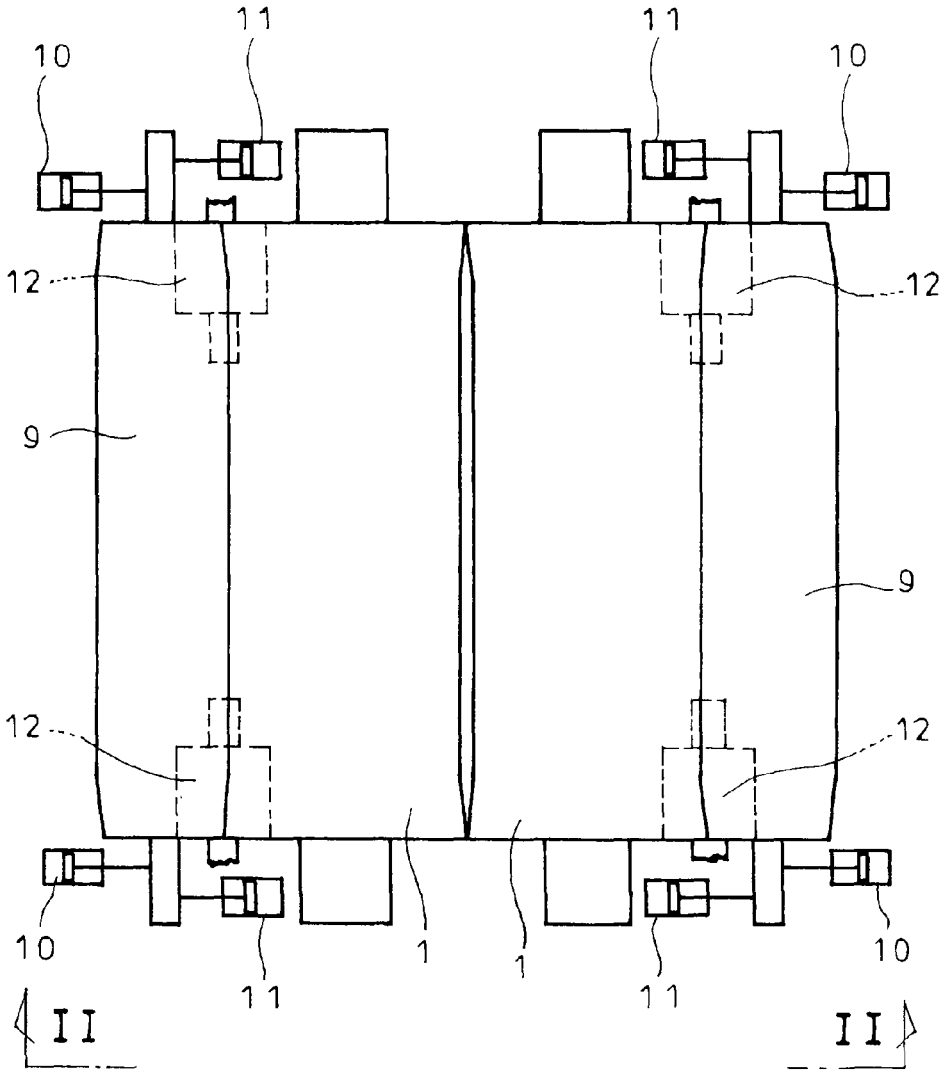
FIG. 1 is a schematic plan view showing an embodiment of a roll polishing apparatus according to the invention.
Figure 2:
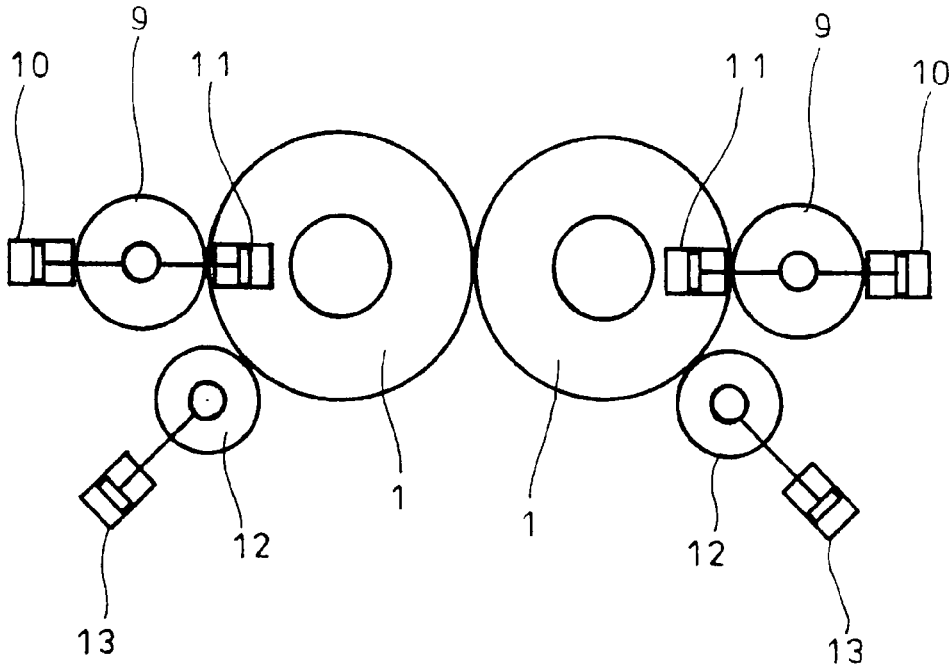
FIG. 2 is a view looking in the direction of arrows II in FIG. 1.

FIGS. 1 and 2 show an embodiment of a roll polishing apparatus according to the invention which comprises brush rolls 9 facing outer peripheries of chilled rolls 1 in a twin roll caster over axial lengths thereof, respectively, pushing cylinders 10 for urging necks of the brush rolls 9 toward the chilled rolls 1, respectively, bending cylinders 11 for urging the necks away from the chilled rolls 1, respectively, auxiliary brush rolls 12 independently of the brush rolls 9 and facing independently one and the other axial ends of the outer peripheries of the chilled rolls 1, respectively, and pushing cylinders 13 for urging necks on the auxiliary brush rolls 12 toward the chilled rolls 1, respectively.

Figure 5:
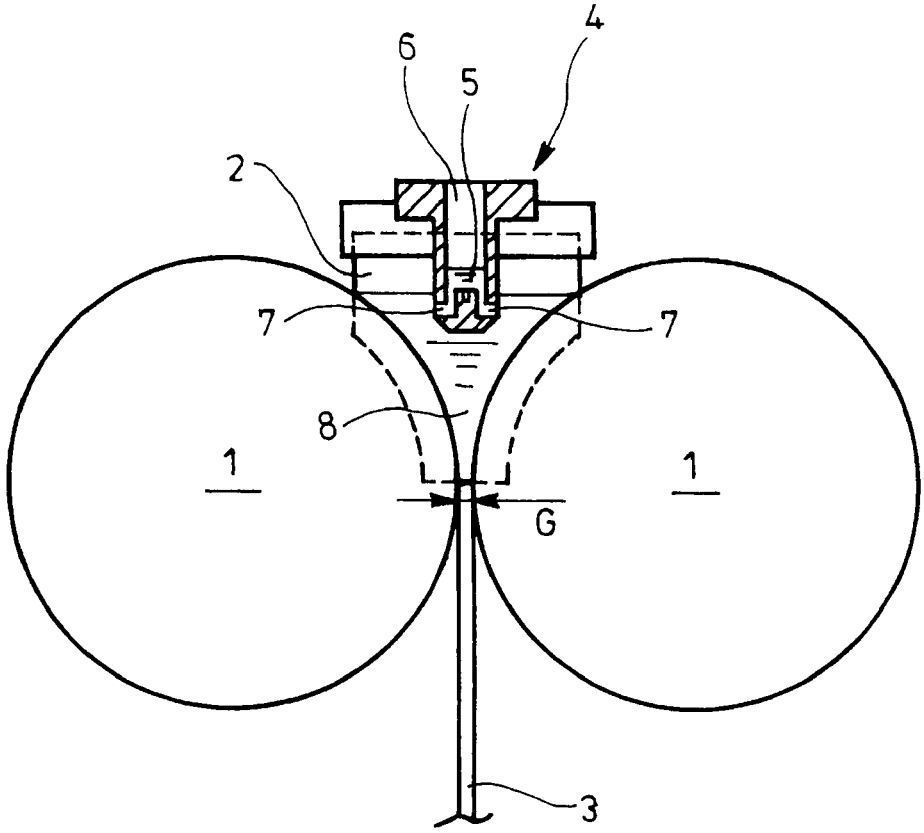
FIG. 5 is a schematic view showing a conventional twin roll caster looking axially of chilled rolls.

The brush rolls 9 are in parallel with the chilled rolls 1 and are arranged to horizontally abut against the outer peripheries of the chilled rolls 1 at positions diametrically away from the nip G (see FIG. 5), respectively.

Each of the brush rolls 9 has wires made of stainless steel and with a diameter of 0.15 mm; each of the brush rolls 9 has a periphery formed such that axially opposite roll ends of the brush roll are smaller in outer diameter than axially intermediate portion in conformity with the chilled roll 1.

The pushing cylinders 10 horizontally and diametrically push the necks of the brush rolls 9 somewhere around their primal ends, respectively, and the bending cylinders 11 horizontally push the necks of the brush rolls 9 somewhere around their distal ends, respectively.

The auxiliary brush rolls 12 are in parallel with the chilled rolls 1 and arranged to abut against the outer peripheries of the chilled rolls 1 from below the brush rolls 9, respectively.

The auxiliary brush rolls 12 also have wires made of stainless steel like the above-mentioned brush rolls 9.

The pushing cylinders 13 push necks of the auxiliary brush rolls 12 toward the axes of the chilled rolls 1, respectively.

The brush rolls 9 and the auxiliary brush rolls 12 are rotatively driven by motors (not shown), respectively.

Specifically, during production of a strip the respective brush rolls 9 are urged to the chilled rolls 1 by the pushing cylinders 10 while being rotated, and at the same time the brush rolls 9 are deformed by the bending cylinders 11 in conformity to the crowns of the chilled rolls 1, respectively, which causes the wires of the brush rolls evenly contact the outer peripheries of the chilled rolls 1 over the axial lengths thereof to wipe off the oxides adhering to the chilled rolls 1, respectively, the effect of cooling the solidified shells at the regions becomes not impaired.

The oxides are efficiently wiped off when distance between the axis of the chilled roll 1 and the axis of the brush roll 9 is set to be shorter by 1 mm than a sum of a radius of the chilled roll 1 and radius of the brush roll 9.

Since each of the brush rolls 9 has the periphery formed such that axially opposite ends are smaller in outer diameter than the axially intermediate portion, convex deformation of the brush rolls 9 against the chilled rolls 1 causes the wires of the brush rolls 9 at their axially opposite ends to properly contact the outer peripheries of the chilled rolls 1, respectively, facilitating the wipe-off of the oxides.

Thus, the oxides adhering to the outer peripheries of the chilled rolls 1 can be effectively wiped off, and no cracks develop somewhere around the widthwise ends or intermediate portions of the surfaces of the strip.

In addition, the auxiliary brush rolls 12 independently of the brush rolls 9 are urged by the pushing cylinders 13 to the chilled rolls 1 while being rotated, the axially opposite ends of the outer peripheries of the chilled roll 1 are circumferentially polished intensively.

Figure 3:
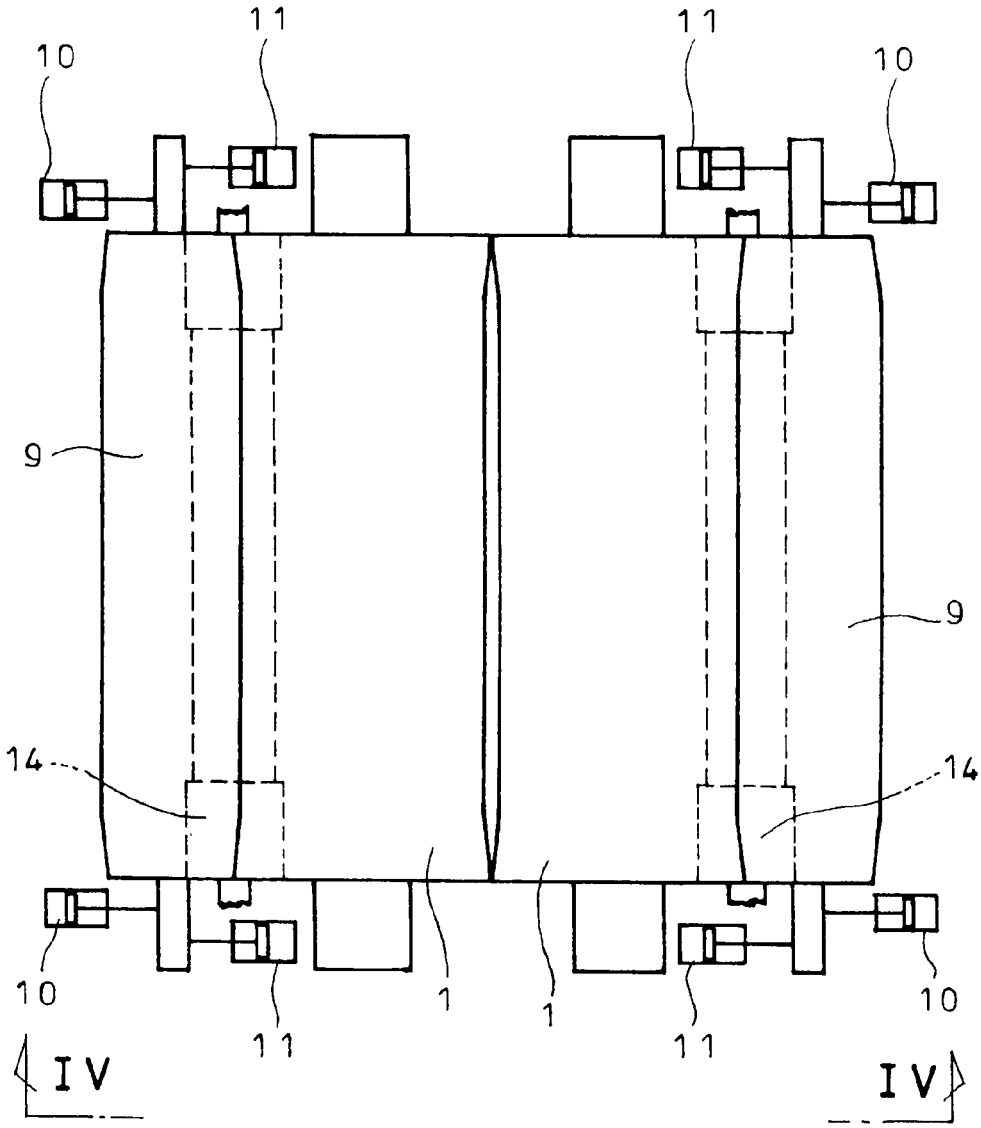
FIG. 3 is a schematic plan view of a further embodiment of a roll polishing apparatus according to the invention.
Figure 4:
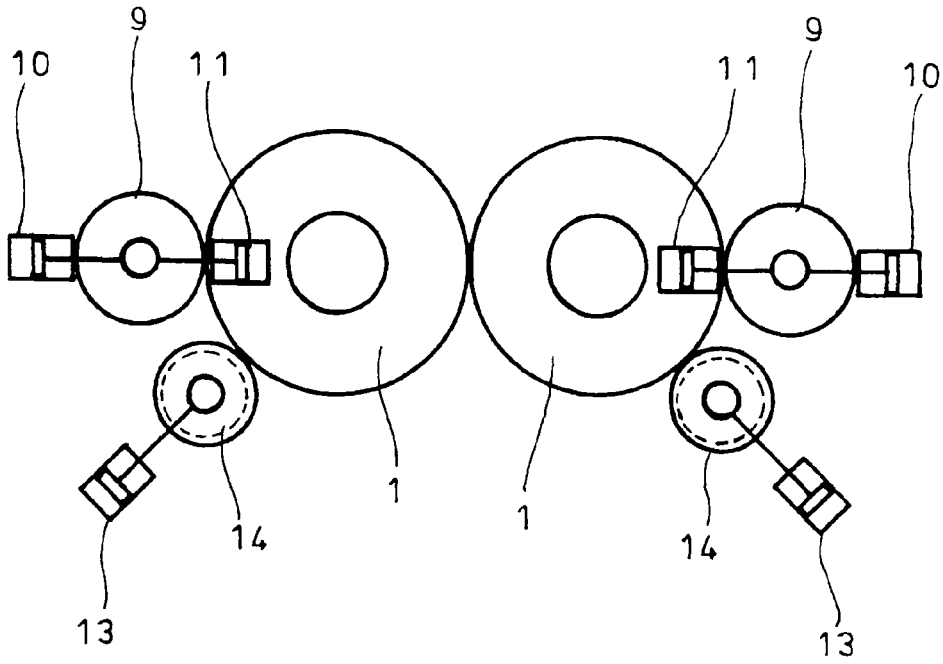
FIG. 4 is a view looking in the direction of arrows IV in FIG. 3.

FIGS. 3 and 4 shows a further embodiment of a roll polishing apparatus of the invention. In the figures, parts shown are identical with those in FIGS. 1 and 2 except for auxiliary brush rolls 14.

Independently of the brush rolls 9, the auxiliary brush rolls 14 face the outer peripheries of the chilled rolls 1 over the axial lengths thereof, respectively.

The auxiliary brush rolls 14 are arranged in parallel with the chilled roll 1 and arranged to abut against the outer peripheries of the chilled rolls 1 from below the auxiliary brush rolls 14, respectively.

Each of the auxiliary brush rolls 14 has wires made of stainless steel with a diameter of 0.15 mm. Each of the brush rolls 9 has a periphery formed such that axially opposite ends of the brush roll are greater in outer diameter than the axially intermediate portion (specifically, length of wires at the axially opposite ends is set to be longer by 1-2 mm than length of the wires at the axially intermediate portion).

The auxiliary brush rolls 14 are rotatively driven by motors (not shown). Necks of the auxiliary brush rolls 14 are urged toward the chilled rolls 1 by pushing cylinders 13.

Specifically, during the production of a strip the respective brush rolls 9 are urged to the chilled rolls 1 by the pushing cylinders 10 while being rotated, and at the same time the brush rolls 9 are deformed by the bending cylinders 11 in conformity to the crowns of the chilled rolls 1, respectively, which causes the wires of the brush rolls evenly contact the outer peripheries of the chilled rolls 1 over the axial lengths thereof to wipe off the oxides adhering to the chilled rolls 1, the effect of cooling the solidified shells at the regions becomes not impaired.

Thus, oxides adhering to the outer peripheries of the chilled rolls 1 can be effectively wiped off, and no cracks develop on somewhere around the widthwise ends or intermediate portions of the surfaces of the strip.

In addition, independently of the brush rolls 9, the auxiliary brush rolls 14 are urged by the pushing cylinders 13 to the chilled rolls 1 while being rotated, respectively, the axially opposite ends of the outer peripheries of the chilled rolls 1 are circumferentially polished intensively.

It is to be understood that a roll polishing apparatus of the invention is not limited to the above embodiments and that various changes and modifications may be made without departing from the scope of the invention.

INDUSTRIAL APPLICABILITY

A roll polishing apparatus of the invention is applicable to various types of twin roll casters.

The invention claimed is:

1. A roll polishing apparatus, comprising:

rotatively driven brush rolls which face outer peripheries of chilled rolls of a twin roll caster over axial lengths thereof, respectively, pushing means for urging said brush rolls wholly to the chilled rolls, respectively, and bending means for deforming said brush rolls in conformity to crowns of the chilled rolls, respectively.

2. A roll polishing apparatus as claim in claim 1, wherein each of the brush rolls has a periphery formed such that axially opposite ends of the brush roll are smaller in outer diameter than an axially intermediate portion.

3. A roll polishing apparatus as claimed in claim 1, further comprising, independently of the brush rolls, rotatively driven auxiliary brush rolls which face the outer peripheries of the chilled rolls, respectively, and pushing means for urging said auxiliary brush rolls wholly to the chilled rolls, respectively.

4. A roll polishing apparatus as claimed in claim 3, wherein said auxiliary brush rolls used are those which face the outer peripheries of the chilled roll over axial lengths thereof, respectively, each of said auxiliary brush rolls having a periphery formed such that the axially opposite ends of the auxiliary brush roll is greater in outer diameter than the axially intermediate portion.

5. A roll polishing apparatus as claimed in claim 2, further comprising, independently of the brush rolls, rotatively driven auxiliary brush rolls which face the outer peripheries of the chilled rolls, respectively, and pushing means for urging said auxiliary brush rolls wholly to the chilled rolls, respectively.

6. A roll polishing apparatus as claimed in claim 5, wherein said auxiliary brush rolls used are those which face the outer peripheries of the chilled roll over axial lengths thereof, respectively, each of said auxiliary brush rolls having a periphery formed such that the axially opposite ends of the auxiliary brush roll is greater in outer diameter than the axially intermediate portion.

* * * * *